US009370699B1

(12) United States Patent
Ines et al.

(10) Patent No.: US 9,370,699 B1
(45) Date of Patent: Jun. 21, 2016

(54) IRON SET GROOVE PROGRESSION

(71) Applicant: Acushnet Company, Fairhaven, MA (US)

(72) Inventors: Marni Ines, Carlsbad, CA (US); Jonathan Hebreo, San Diego, CA (US); Michael E. Franz, Encinitas, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/675,050

(22) Filed: Mar. 31, 2015

(51) Int. Cl.
*A63B 53/04* (2015.01)
*A63B 53/00* (2015.01)

(52) U.S. Cl.
CPC ..... *A63B 53/047* (2013.01); *A63B 2053/005* (2013.01); *A63B 2053/0408* (2013.01); *A63B 2053/0445* (2013.01)

(58) Field of Classification Search
CPC ..... A63B 53/047; A63B 2053/005; A63B 2053/0408; A63B 2053/0445
See application file for complete search history.

(56) References Cited

U.S. PATENT DOCUMENTS 4,529,203 A 7/1985 Ribaudo
4,754,970 A 7/1988 Kobayashi
4,754,971 A 7/1988 Kobayashi
4,858,929 A 8/1989 Long
5,029,864 A 7/1991 Keener
5,090,702 A 2/1992 Viste
5,354,059 A 10/1994 Stuff
5,358,249 A 10/1994 Mendralla
5,591,092 A * 1/1997 Gilbert ..... A63B 53/04 473/330
5,688,186 A 11/1997 Michaels et al.
7,014,568 B2 3/2006 Pelz
7,803,062 B2 * 9/2010 Gilbert ..... A63B 53/047 473/290
8,029,384 B2 * 10/2011 Chen ..... A63B 53/047 473/331
8,109,840 B2 * 2/2012 Gilbert ..... A63B 53/04 473/330
8,409,029 B2 * 4/2013 Abe ..... A63B 53/047 473/290
2002/0049096 A1 * 4/2002 Doolen ..... A63B 53/04 473/330
2005/0043113 A1 * 2/2005 Mann ..... A63B 53/04 473/330
2014/0345107 A1 * 11/2014 Solheim ..... A63B 53/047 29/428

FOREIGN PATENT DOCUMENTS

JP 5161692 B2 * 3/2013 ..... A63B 53/00
JP 5260473 B2 * 8/2013 ..... A63B 53/047

OTHER PUBLICATIONS

Groove Measurement Procedure Outline, USGA-TPX3001, Revision 1.0.0, Aug. 2008, by the United States Golf Association and R&A Rules.

* cited by examiner

*Primary Examiner* — Stephen Blau
(74) *Attorney, Agent, or Firm* — Kevin N. McCoy

(57) ABSTRACT

A set of iron type golf club heads comprising a plurality of iron type golf club heads, the plurality of iron type golf club heads comprising a long iron, a mid iron, and a short iron; wherein each of the plurality of iron type golf club heads comprise a striking face, and wherein each of the plurality of iron type golf club heads comprise a plurality of grooves formed in the striking face extending generally from a heel side of the striking face towards a toe side of the striking face; wherein the plurality of grooves of each of the plurality of iron type golf club heads comprise a groove pitch measurement, wherein the groove pitch of the plurality of grooves of the long iron is greater than the groove pitch of the plurality of grooves of the short iron.

19 Claims, 3 Drawing Sheets

IRON SET GROOVE PROGRESSION

TECHNICAL FIELD

This present technology generally relates to sets of iron golf clubs, and more specifically to sets of iron golf clubs with progressive groove geometry.

DESCRIPTION OF THE RELATED TECHNOLOGY

In conventional sets of "iron" golf clubs, each golf club includes a shaft with a club head attached to the distal end of the shaft and a grip attached to the proximal end of the shaft. The club head includes a face for striking a golf ball. In general, the greater the loft of the golf club in a set, the greater the launch angle and the less distance the golf ball is hit.

A set of irons generally includes individual irons that are designated as number 3 through number 9, and a pitching wedge. The iron set is generally complimented by a series of wedges, such as a lob wedge, a gap wedge, and/or a sand wedge. Sets can also include a 1 and 2 iron, but these golf clubs are generally sold separately from the set. Each iron has a shaft length that usually decreases through the set as the set as the loft for each golf club head increases, from the long irons to the short irons. Additionally, iron golf clubs generally include grooves running across the striking face from the heel towards the toe to increase the friction between the striking face and golf ball, inducing spin on the golf ball as the striking face impacts the golf ball.

The length of the club, along with the club head loft, and groove geometry impart various performance characteristics to the ball's launch conditions upon impact. The initial trajectory of the ball generally extends between the impact point and the apex or peak of the trajectory. In general, the ball's trajectory for the long irons is a more penetrating, lower trajectory due to the lower launch angle of the increased ball speed off of the club. Short irons produce a trajectory that is substantially steeper and less penetrating than the trajectory of balls struck by long irons. The highest point of a long iron's ball flight is generally lower than the highest point for a short iron's ball flight. The backspin of the golf ball after it leaves the striking face also affects the trajectory. More backspin will create more lift due to the dimple geometry on the external surface of the golf ball, lift causes the ball to travel higher. Too much spin can cause the ball to "balloon" where the trajectory is more vertical than a golfer would prefer, sacrificing distance, and allowing the weather conditions to have a greater effect on the flight of the ball.

SUMMARY

The systems, methods, and devices described herein have innovative aspects, no single one of which is indispensable or solely responsible for their desirable attributes. Without limiting the scope of the claims, some of the advantageous features will now be summarized.

One aspect of the present technology is the realization that certain types of players have particular preferences when it comes to backspin and ball flight from different irons in a set of iron golf clubs. Thus, there exists a need for an improved iron type golf club set. The present technology is directed to sets of iron golf clubs incorporating progressive groove geometry. The progressive groove geometry provides preferable backspin and ball flight characteristics, improving a player's ability to lower their score.

One non-limiting embodiment of the present technology includes a set of iron type golf club heads, comprising a plurality of iron type golf club heads, the plurality of iron type golf club heads comprising a long iron having a loft angle greater than or equal to 15 degrees and less than 26 degrees, a mid iron having a loft angle greater than or equal to 26 degrees and less than 37 degrees, and a short iron having a loft angle greater than or equal to 37 degrees and less than 47 degrees; wherein each of the plurality of iron type golf club heads comprise a striking face, and wherein each of the plurality of iron type golf club heads comprise a plurality of grooves formed in the striking face extending generally from a heel side of the striking face towards a toe side of the striking face; wherein the plurality of grooves of each of the plurality of iron type golf club heads comprise a groove pitch measurement, wherein the groove pitch of the plurality of grooves of the long iron is greater than the groove pitch of the plurality of grooves of the short iron.

In an additional non-limiting embodiment of the present technology the groove pitch of the plurality of grooves of the mid iron is less than the groove pitch of the plurality of grooves of the long iron.

In an additional non-limiting embodiment of the present technology the groove pitch of the plurality of grooves of the mid iron is greater than the groove pitch of the plurality of grooves of the short iron.

In an additional non-limiting embodiment of the present technology wherein the groove pitch of the plurality of grooves of the long iron is greater than or equal to 0.15" and less than or equal to 0.20".

In an additional non-limiting embodiment of the present technology the groove pitch of the plurality of grooves of the short iron is greater than or equal to 0.10" and less than or equal to 0.15".

In an additional non-limiting embodiment of the present technology the groove pitch measurement increases through the set of iron type golf club heads in a substantially linear relationship as the loft of each of the plurality of iron type golf club heads decreases.

An additional non-limiting embodiment of the present technology includes a set of iron type golf club heads, comprising a plurality of iron type golf club heads, the plurality of iron type golf club heads comprising a long iron having a loft angle greater than or equal to 15 degrees and less than 26 degrees, a mid iron having a loft angle greater than or equal to 26 degrees and less than 37 degrees, and a short iron having a loft angle greater than or equal to 37 degrees and less than 47 degrees; wherein each of the plurality of iron type golf club heads comprise a striking face, and wherein each of the plurality of iron type golf club heads comprise a plurality of grooves formed in the striking face extending generally from a heel side of the striking face towards a toe side of the striking face; wherein the plurality of grooves of each of the plurality of iron type golf club heads comprise an edge radius, wherein the edge radius of the plurality of grooves of the long iron is greater than the edge radius of the plurality of grooves of the short iron.

In an additional non-limiting embodiment of the present technology the edge radius of the plurality of grooves of the mid iron is greater than the edge radius of the short iron.

In an additional non-limiting embodiment of the present technology the edge radius of the plurality of grooves of the mid iron is less than the edge radius of the long iron.

In an additional non-limiting embodiment of the present technology the edge radius of the plurality of grooves of the short iron is less than 0.005".

In an additional non-limiting embodiment of the present technology the edge radius of the plurality of grooves of the long iron is greater than or equal to 0.007" and less than or equal to 0.020".

In an additional non-limiting embodiment of the present technology the edge radius of the plurality of grooves of the mid iron is greater than or equal to 0.005" and less than or equal to 0.007".

In an additional non-limiting embodiment of the present technology the edge radius increases through the set of iron type golf club heads in a substantially linear relationship as the loft of each of the plurality of iron type golf club heads decreases.

An additional non-limiting embodiment of the present technology includes a set of iron type golf club heads, comprising a plurality of iron type golf club heads, the plurality of iron type golf club heads comprising a long iron having a loft angle greater than or equal to 15 degrees and less than 26 degrees, a mid iron having a loft angle greater than or equal to 26 degrees and less than 37 degrees, and a short iron having a loft angle greater than or equal to 37 degrees and less than 47 degrees; wherein each of the plurality of iron type golf club heads comprise a striking face, and wherein each of the plurality of iron type golf club heads comprise a plurality of grooves formed in the striking face extending generally from a heel side of the striking face towards a toe side of the striking face; wherein the plurality of grooves of each of the plurality of iron type golf club heads comprise a draft angle, wherein the draft angle of the plurality of grooves of the long iron is less than the draft angle of the plurality of grooves of the short iron.

In an additional non-limiting embodiment of the present technology the draft angle of the plurality of grooves of the mid iron is greater than the draft angle of the plurality of grooves of the long iron.

In an additional non-limiting embodiment of the present technology the draft angle of the plurality of grooves of the mid iron is less than the draft angle of the plurality of grooves the short iron.

In an additional non-limiting embodiment of the present technology the plurality of grooves of each of the plurality of iron type golf club heads comprise a width, wherein the width of the plurality of grooves of the long iron is less than the width of the plurality of grooves of the short iron.

In an additional non-limiting embodiment of the present technology the plurality of grooves of the mid iron is greater than the width of the plurality of grooves of the long iron.

In an additional non-limiting embodiment of the present technology the plurality of grooves of each of the plurality of iron type golf club heads comprise a groove pitch measurement, wherein the groove pitch of the plurality of grooves of the long iron is greater than the groove pitch of the plurality of grooves of the mid iron.

In an additional non-limiting embodiment of the present technology the plurality of grooves of each of the plurality of iron type golf club heads comprise a groove pitch measurement, wherein the groove pitch of the plurality of grooves of the short iron is greater than the groove pitch of the plurality of grooves of the mid iron.

In an additional non-limiting embodiment of the present technology said plurality of grooves of each of said plurality of iron type golf club heads comprise a groove pitch measurement, wherein said groove pitch of said plurality of grooves of said short iron is greater than said groove pitch of said plurality of grooves of said mid iron.

BRIEF DESCRIPTION OF THE DRAWINGS

The accompanying drawings form a part of the specification and are to be read in conjunction therewith. The illustrated embodiments, however, are merely examples and are not intended to be limiting. Like reference numbers and designations in the various drawings indicate like elements.

DETAILED DESCRIPTION

Figure 1:
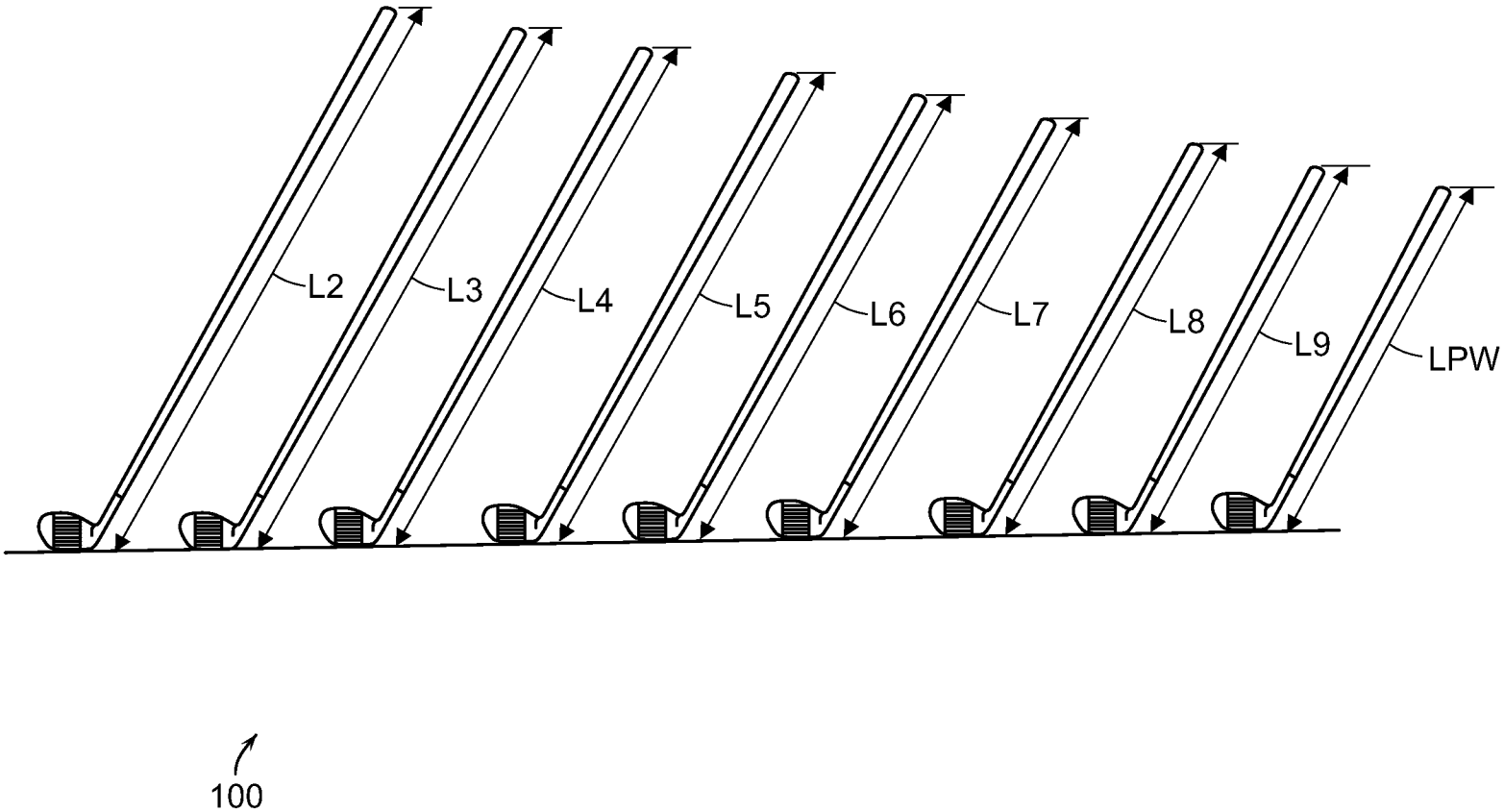
FIG. 1 illustrates one embodiment of a set of iron golf clubs.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure.

Embodiments described herein generally relate to sets of iron golf clubs. More specifically, some embodiments relate to progressive groove geometry throughout a set of iron golf clubs.

Figure 2:
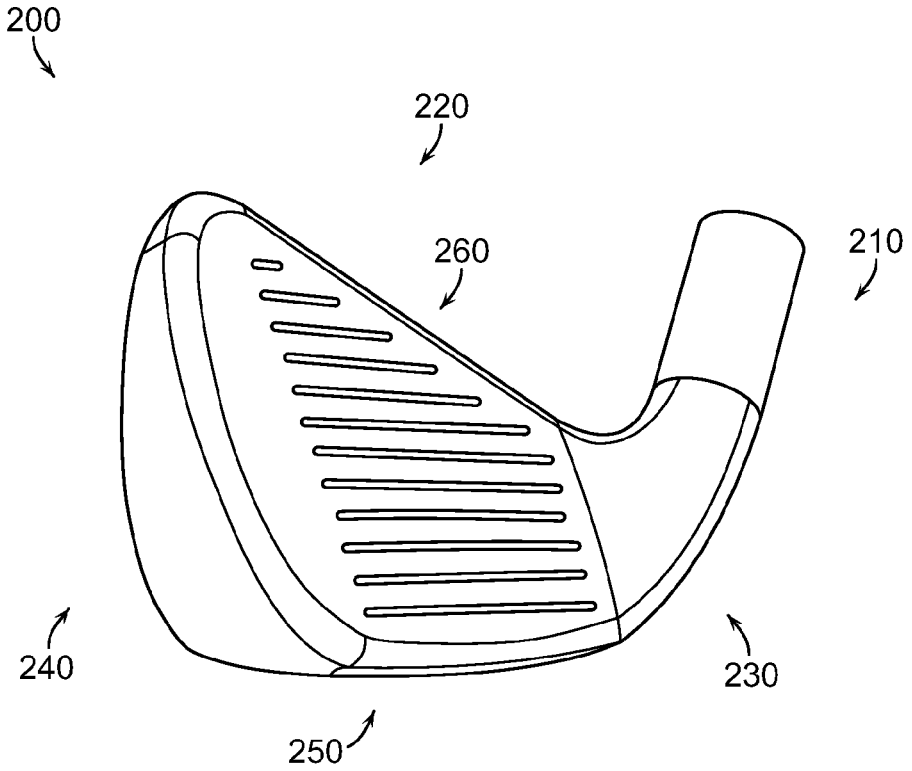
FIG. 2 illustrates a perspective view of one embodiment of an iron type golf club head.
Figure 3:
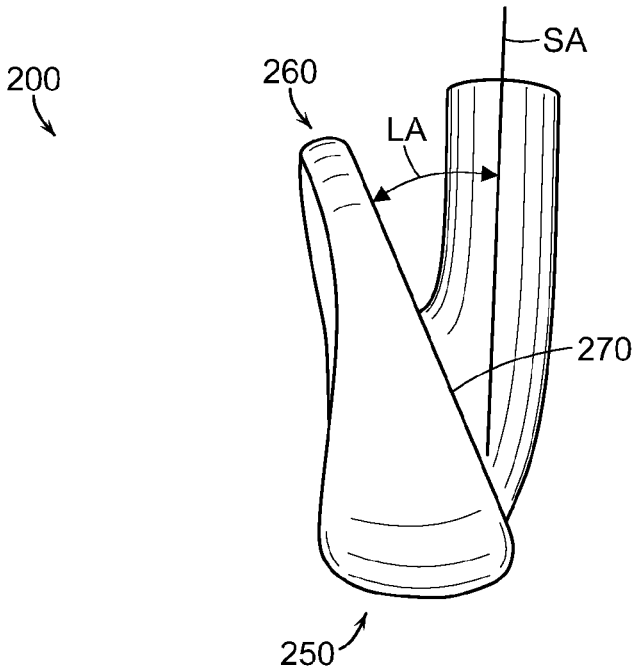
FIG. 3 illustrates a side view of the golf club head of FIG. 2.

FIG. 1 illustrates one embodiment of a set of iron golf clubs 100. The particular set 100 illustrated in FIG. 1 includes a 2 iron through a pitching wedge. FIG. 2 illustrates a perspective view of one embodiment of an iron type golf club head 200. The golf club head 200 includes a hosel 210 connected to a body portion 220. The hosel 210 is located on the heel side 230 of the body portion 220, opposite the toe side 240 of the body portion 230. The hosel 210 is configured to receive the shaft of the golf club. The club head 200 includes a sole 250 on a lower surface of the body portion 230 and a topline 260 at the top of the body portion 230. Additionally, the body portion 230 includes a striking face 270 configured to strike a golf ball. FIG. 3 illustrates a side view of the golf club head 200 of FIG. 2. As illustrated in FIG. 3, the golf club head 200 has a shaft axis SA extending through the center of the hosel 210. The angle LA formed between the shaft axis SA and a plane formed on the outer surface 280 of the striking face 270 is the loft LA of the golf club head 200.

As illustrated in FIG. 1, the golf clubs generally decrease in length (L2, L3, etc) as you move through the set 100 from the long irons to the short irons. Additionally, the loft LA of the golf club head 200 generally increases as you move through the set 200 from the long irons to the short irons. The long irons are defined as having a loft angle LA greater than or equal to 15 degrees and less than 26 degrees. The mid-irons are defined as having a loft angle LA greater than or equal to 26 degrees and less than 37 degrees. The short irons are defined as having a loft angle LA greater than or equal to 37 degrees and less than 47 degrees.

Figure 4:
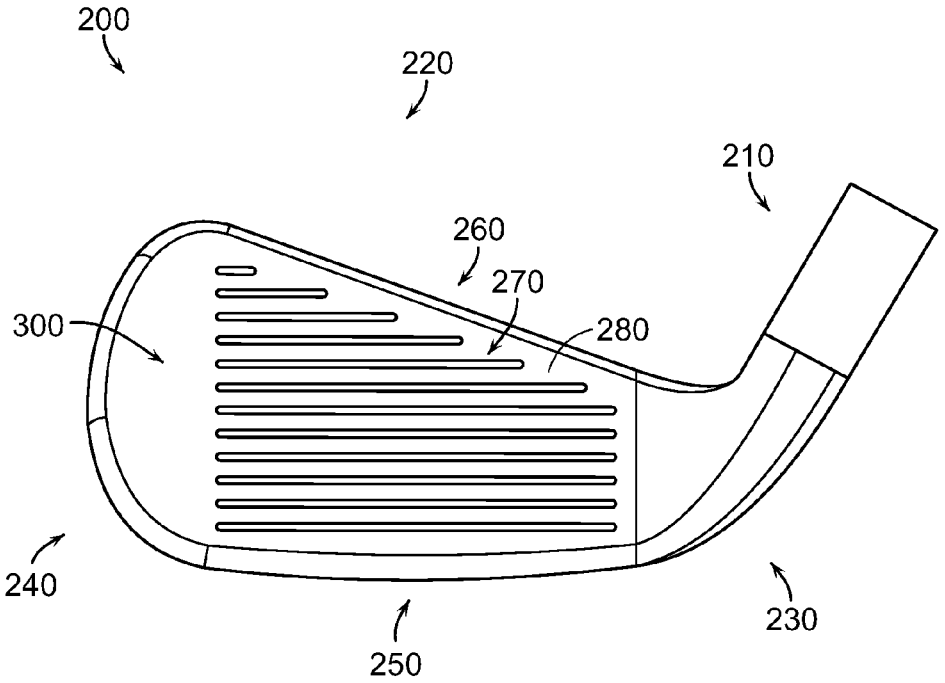
FIG. 4 illustrates a front view of the golf club head of FIG. 2.
Figure 5:
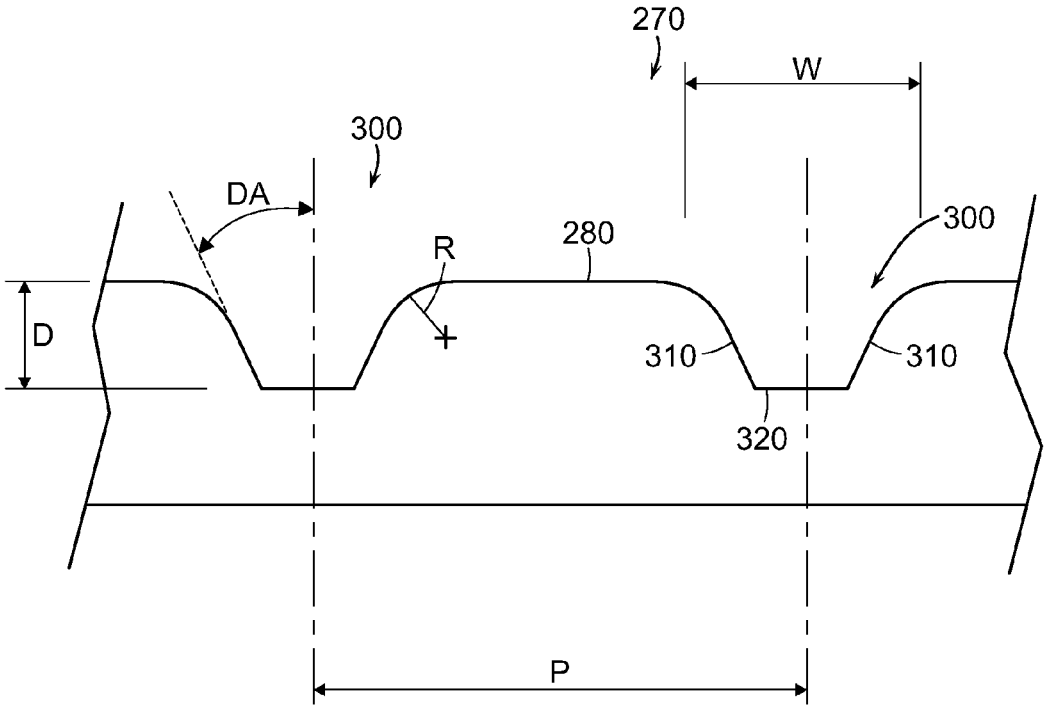
FIG. 5 illustrates a cross section of a portion of the striking face of the golf club head of FIG. 2 including a plurality of grooves.

FIG. 4 illustrates a front view of the golf club 200 head of FIG. 2. As illustrated in FIG. 4, the golf club head 200 includes grooves 300 formed in the striking face 270. FIG. 5 illustrates a cross section of the striking face 270 including a plurality of grooves 300. In some embodiments, each groove 300 can include two walls 310 and a base 320. In other embodiments, the walls 310 can converge on one another, and the groove 300 may not include a base 320. Each groove 300 has a width W. The procedure for measuring the width W of the groove 300 is outlined in the Groove Measurement Procedure Outline, USGA-TPX3001, Revision 1.0.0, August, 2008, by the United States Golf Association and R&A Rules Limited. Each groove 300 has a depth D, measured perpendicular from the outer surface 280 of the striking face 270, from the outer surface 280 of the striking face 270 to the deepest portion of the groove 300. In some embodiments, each groove 300 comprises a fillet with radius R at the intersection of the wall 310 and the outer surface 280 of the striking face 270. In other embodiments, the wall 310 of the groove 300 may meet the outer surface 280 of the striking face 270 at a sharp point, effectively creating a very small fillet radius R. Additionally, each groove 300 can include a draft angle DA, measured between each wall 310 of the groove 300 and a plane perpendicular to the outer surface 280 of the striking face 270 and extending along the center of the groove 300 along the length of the groove 300. Finally, the plurality of grooves 300 can include a pitch P, defined as the distance between the centers of each groove 300.

Grooves effect the backspin of a ball as the ball leaves the striking face of the golf club head after being struck. It can be advantageous to tailor the backspin produced by each club in an iron set, in order to tailor the trajectory and ball flight characteristics through the set. In some embodiments, iron sets described herein tailor the backspin produced by each club by incorporating different groove geometry in certain clubs than others. Different types of players have different swing characteristics which may require different groove configurations and variations through the iron set. Some players may have higher swing speeds than others. Some players may spin the ball more than others. Therefore, multiple embodiments of spin requirements and groove configurations are described herein, each of which may suit a different type of player.

One particular type of player may prefer less spin in the long irons to increase the roll out when the ball hits the ground, increasing total distance. This type of player may prefer more spin in the short irons to keep the ball in the air longer and for better stopping power on the greens.

Another type of player may prefer may prefer more spin in the long irons, enabling the ball to stay in the air longer and come down with a steeper slope to hold the greens better. This type of player may prefer less spin in the short irons, as the loft already produces the height and trajectory needed, but they do not want the ball to balloon. Ballooning can be described as the ball climbing too steeply into the air from a combination of high initial trajectory as well as high spin, the effect being less consistent distance and higher susceptibility to weather conditions affecting the flight of the ball.

Another type of player may prefer more spin in the long irons, enabling the ball to stay in the air longer and come down with a steeper slope to hold the greens better. This type of player may prefer less spin in the mid irons, as the loft already produces the height and trajectory needed, but they do not want the ball to balloon. This type of player may prefer more spin in the short irons, to keep the ball in the air longer and for better stopping power on the greens.

Several groove 300 geometry parameters which can affect spin include draft angle DA, edge radius R, pitch P, width W, and depth D. These parameters are illustrated in FIG. 5 and described above. In some embodiments, one or more of these parameters may vary between clubs in an iron set 100. Other parameters may remain substantially constant through the set 100.

Groove draft angle DA can influence the spin of a golf ball struck by a golf club head 200. Generally, a small draft angle DA results in higher spin than a large draft angle DA. Groove draft angles DA can range from 0 degrees to approximately 45 degrees. In some embodiments groove draft angle DA remains substantially constant through a set 100. Examples of constant draft angles DA include 0 degrees, 2 degrees, 22 degrees, 43 degrees, 45 degrees etc. In other embodiments, groove draft angle DA can vary through a set 100. In some embodiments, the draft angle DA can be smaller in the long irons than the short irons. The draft angle DA in the mid irons can be larger than the long irons and smaller than the short irons.

In some embodiments, the draft angle of the grooves in the short irons can be between 35 and 50 degrees, the draft angle of the grooves in the mid irons can be between 15 and 35 degrees, and the draft angle of the grooves in the long irons can be between 0 and 15 degrees. In another embodiment, the draft angle of the grooves in the short irons can be between 35 and 45 degrees, the draft angle of the grooves in the mid irons can be between 20 and 30 degrees, and the draft angle of the grooves in the long irons can be between 0 and 10 degrees. In another embodiment, the draft angle of the grooves in the short irons can be between 40 and 45 degrees, the draft angle of the grooves in the mid irons can be between 20 and 25 degrees, and the draft angle of the grooves in the long irons can be between 0 and 5 degrees.

In some embodiments, the groove draft angle DA can be directly related to the loft LA of the golf club head. The groove draft angle DA can be calculated by subtracting 13 from the loft LA of the golf club head. In some embodiments, the groove draft angle DA can be between a range of values, the lower value calculated by subtracting 28 from the loft angle 1A, the higher value calculated by adding 2 to the loft angle LA. In some embodiments, the groove draft angle DA can be between a range of values, the lower value calculated by subtracting 18 from the loft angle LA, the higher value calculated by subtracting 8 from the loft angle LA.

Groove edge radius R can influence the spin of a golf ball struck by a golf club head 200. Generally, a small edge radius R results in higher spin than a large edge radius R. Groove edge radius R can range from infinitely small to approximately 0.020". In some embodiments groove edge radius R remains substantially constant through a set 100. Examples of constant edge radius R can include 0.02", 0.015", 0.010", a sharp corner resulting in an infinitely thin edge radius R, etc. In other embodiments, groove edge radius R can vary through a set 100. In some embodiments, the edge radius R can be larger in the long irons than the short irons. The edge radius R can be larger in the mid irons than the short irons and smaller in the mid irons than the long irons.

In some embodiments, the edge radius R of the grooves 300 in the long irons can be between 0.007" and 0.020", the edge radius R of the grooves 300 in the mid irons can be between 0.005" and 0.007", and the edge radius R in the short irons can be less than 0.005". In some embodiments, the edge radius R of the grooves 300 in the long irons can be between 0.008" and 0.015", the edge radius R of the grooves 300 in the mid irons can be between 0.005" and 0.007", and the edge radius R in the short irons can be less than 0.005". In some embodiments, the edge radius R of the grooves 300 in the long irons can be between 0.009" and 0.011", the edge radius R of the grooves 300 in the mid irons can be between 0.005" and 0.007", and the edge radius R in the short irons can be less than 0.001".

In some embodiments, groove edge radius R can be directly related to the loft LA of the golf club head 200. The groove edge radius R can be computed by multiplying the loft LA by −0.0003 and then adding 0.015. In some embodiments, the groove edge radius R of a golf club head 300 can be within a range, the lower end of the range computed by multiplying the loft LA by −0.0003 and then adding 0.013, and the upper end of the range computed by multiplying the loft LA by −0.0003 and then adding 0.017.

Groove pitch P can influence the spin of a golf ball struck by a golf club head 300. Generally, a large pitch value P results in higher spin than a small pitch value P. Groove pitch P can range from approximately 0.073" to approximately 0.500". In some embodiments groove pitch P remains substantially constant through a set 100. Examples of constant groove pitch values P can include 0.1", 0.15", 0.2", etc. In other embodiments, groove pitch P can vary through a set 100. In some embodiments, the groove pitch value P can be larger in the long irons than the short irons. In some embodiments, the groove pitch value P can be larger in the mid irons than the short irons and smaller in the mid irons than the long irons. In another embodiment the groove pitch P in the mid irons can be smaller than the groove pitch P of the long irons and the groove pitch P of the short irons.

In some embodiments, the groove pitch P in the long irons can be between 0.15" and 0.20" and the groove pitch P in the short irons can be between 0.10" and 0.15". In other embodiments, the groove pitch P in the long irons can be between 0.15" and 0.20", the groove pitch P in the mid irons can be between 0.10" and 0.15", and the groove pitch P in the short irons can be between 0.15" and 0.20".

In some embodiments groove pitch P can be directly related to the loft LA of the golf club head. The groove pitch P can be calculated by multiplying the loft LA by −0.0031 and then adding 0.25. In some embodiments, the groove pitch P of a golf club head can be within a range, the lower end of the range computed by multiplying the loft LA by −0.0031 and then adding 0.23, and the upper end of the range computed by multiplying the loft LA by −0.0031 and then adding 0.27.

Groove width W can influence the spin of a golf ball struck by a golf club head 200. Generally, a large width W results in higher spin than a small width W. Groove width W can range from approximately 0.005" to approximately 0.037". In some embodiments groove width W remains substantially constant through a set 100. Examples of constant groove widths W can include 0.02", 0.025", 0.036", etc. In other embodiments, groove width W can vary through a set 100. In some embodiments, the groove width W of the long irons is less than the groove width W of the short irons. In some embodiments, the groove width W of the mid irons is greater than the groove width W of the long irons.

In some embodiments, the groove width W of the long irons can be between 0.01" and 0.03" and the groove width W of the short irons can be between 0.03" and 0.037". The groove width W of the mid irons can also be between 0.03" and 0.037".

Groove depth D can influence the spin of a golf ball struck by a golf club head 200. Generally, a large groove depth D results in higher spin than a small groove depth D. Groove depth D can range from approximately 0.005" to approximately 0.022". In some embodiments groove depth D remains substantially constant through a set. Examples of constant groove depth D can include 0.01", 0.014", 0.015", 0.02", 0.022", etc. In other embodiments, groove depth can vary through a set.

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

We claim:

1. A set of iron type golf club heads, comprising:

a plurality of iron type golf club heads, said plurality of iron type golf club heads comprising a long iron having a loft angle greater than or equal to 15 degrees and less than 26 degrees, a mid iron having a loft angle greater than or equal to 26 degrees and less than 37 degrees, and a short iron having a loft angle greater than or equal to 37 degrees and less than 47 degrees;

wherein each of said plurality of iron type golf club heads comprise a striking face, and wherein each of said plurality of iron type golf club heads comprise a plurality of grooves formed in said striking face extending generally from a heel side of said striking face towards a toe side of said striking face;

wherein said plurality of grooves of each of said plurality of iron type golf club heads comprise an edge radius, wherein said edge radius of said plurality of grooves of said long iron is greater than said edge radius of said plurality of grooves of said short iron;

wherein said edge radius of said plurality of grooves is the radius of the edge at the intersection of a wall of each groove of said plurality of grooves and an outer surface of the striking face;

wherein said edge radius of said plurality of grooves of said short iron is less than 0.005".

2. The golf club head of claim 1, wherein said edge radius of said plurality of grooves of said mid iron is greater than said edge radius of said short iron.

3. The golf club head of claim 1, wherein said edge radius of said plurality of grooves of said mid iron is less than said edge radius of said long iron.

4. The golf club head of claim 1, wherein said edge radius of said plurality of grooves of said long iron is greater than or equal to 0.007" and less than or equal to 0.020".

5. The golf club head of claim 1, wherein said edge radius of said plurality of grooves of said mid iron is greater than or equal to 0.005" and less than or equal to 0.007".

6. The golf club head of claim 1, wherein said edge radius increases through said set of iron type golf club heads in a substantially linear relationship as said loft of each of said plurality of iron type golf club heads decreases.

7. A set of iron type golf club heads, comprising:

a plurality of iron type golf club heads, said plurality of iron type golf club heads comprising a long iron having a loft angle greater than or equal to 15 degrees and less than 26 degrees, a mid iron having a loft angle greater than or equal to 26 degrees and less than 37 degrees, and a short iron having a loft angle greater than or equal to 37 degrees and less than 47 degrees;

wherein each of said plurality of iron type golf club heads comprise a striking face, and wherein each of said plurality of iron type golf club heads comprise a plurality of grooves formed in said striking face extending generally from a heel side of said striking face towards a toe side of said striking face;

wherein said plurality of grooves of each of said plurality of iron type golf club heads comprise a draft angle, wherein said draft angle of said plurality of grooves of said long iron is less than said draft angle of said plurality of grooves of said short iron;

wherein said draft angle of said plurality of grooves is the angle measured between each wall of each groove of said plurality of grooves and a plane perpendicular to an outer surface of the striking face.

8. The golf club head of claim 7, wherein said draft angle of said plurality of grooves of said mid iron is greater than said draft angle of said plurality of grooves of said long iron.

9. The golf club head of claim 7, wherein said draft angle of said plurality of grooves of said mid iron is less than said draft angle of said plurality of grooves of said short iron.

10. The golf club head of claim 7, wherein said plurality of grooves of each of said plurality of iron type golf club heads comprise a width, wherein said width of said plurality of grooves of said long iron is less than said width of said plurality of grooves of said short iron.

11. The golf club head of claim 10, wherein said plurality of grooves of said mid iron is greater than said width of said plurality of grooves of said long iron.

12. The golf club head of claim 7, wherein said plurality of grooves of each of said plurality of iron type golf club heads comprise a groove pitch measurement, wherein said groove pitch of said plurality of grooves of said long iron is greater than said groove pitch of said plurality of grooves of said mid iron.

13. The golf club head of claim 12, wherein said plurality of grooves of each of said plurality of iron type golf club heads comprise a groove pitch measurement, wherein said groove pitch of said plurality of grooves of said short iron is greater than said groove pitch of said plurality of grooves of said mid iron.

14. A set of iron type golf club heads, comprising:

a plurality of iron type golf club heads, said plurality of iron type golf club heads comprising a long iron having a loft angle greater than or equal to 15 degrees and less than 26 degrees, a mid iron having a loft angle greater than or equal to 26 degrees and less than 37 degrees, and a short iron having a loft angle greater than or equal to 37 degrees and less than 47 degrees;

wherein each of said plurality of iron type golf club heads comprise a striking face, and wherein each of said plurality of iron type golf club heads comprise a plurality of grooves formed in said striking face extending generally from a heel side of said striking face towards a toe side of said striking face;

wherein said plurality of grooves of each of said plurality of iron type golf club heads comprise an edge radius, wherein said edge radius of said plurality of grooves of said long iron is greater than said edge radius of said plurality of grooves of said short iron;

wherein said edge radius of said plurality of grooves is the radius of the edge at the intersection of a wall of each groove of said plurality of grooves and an outer surface of the striking face;

wherein said edge radius of said plurality of grooves of said mid iron is greater than or equal to 0.005" and less than or equal to 0.007".

15. The golf club head of claim 14, wherein said edge radius of said plurality of grooves of said mid iron is greater than said edge radius of said short iron.

16. The golf club head of claim 14, wherein said edge radius of said plurality of grooves of said mid iron is less than said edge radius of said long iron.

17. The golf club head of claim 14, wherein said edge radius of said plurality of grooves of said short iron is less than 0.005".

18. The golf club head of claim 17, wherein said edge radius of said plurality of grooves of said long iron is greater than or equal to 0.007" and less than or equal to 0.020".

19. The golf club head of claim 14, wherein said edge radius increases through said set of iron type golf club heads in a substantially linear relationship as said loft of each of said plurality of iron type golf club heads decreases.

* * * * *